US007021826B2

(12) United States Patent
Benjamins

(10) Patent No.: US 7,021,826 B2
(45) Date of Patent: Apr. 4, 2006

(54) LOCKABLE CONTAINER HAVING TAMPER EVIDENT LOCK UNIT

(75) Inventor: Arthur Michel Benjamins, Biggin Hill (GB)

(73) Assignee: ITW Limited, Swansea (GB)

( * ) Notice: Subject to any disclaimer, the term of this patent is extended or adjusted under 35 U.S.C. 154(b) by 399 days.

(21) Appl. No.: 10/182,022

(22) PCT Filed: Jan. 10, 2001

(86) PCT No.: PCT/GB01/00088

§ 371 (c)(1),
(2), (4) Date: Oct. 9, 2003

(87) PCT Pub. No.: WO01/53163

PCT Pub. Date: Jul. 26, 2001

(65) Prior Publication Data

US 2004/0117956 A1 Jun. 24, 2004

(30) Foreign Application Priority Data

Jan. 19, 2000 (GB) ..... 0001218

(51) Int. Cl.
*B65D 33/26* (2006.01)

(52) U.S. Cl. ..... 383/92; 383/5; 292/307 R

(58) Field of Classification Search ..... 383/5, 383/92; 292/316, 327, 91, 307 R; 24/30.5 R, 24/704.1

See application file for complete search history.

(56) References Cited

U.S. PATENT DOCUMENTS

| | | | | |
|---|---|---|---|---|
| 3,138,842 A | | 6/1964 | Henry | |
| 3,955,842 A | | 5/1976 | Edwards | |
| 4,602,405 A | * | 7/1986 | Sturman et al. | 24/385 |
| 4,740,090 A | * | 4/1988 | McNamee | 383/5 |
| 5,924,797 A | * | 7/1999 | Netto | 383/5 |
| 6,116,666 A | * | 9/2000 | Adamson et al. | 292/307 R |

FOREIGN PATENT DOCUMENTS

| | | |
|---|---|---|
| CH | 476 925 A | 8/1969 |
| GB | 854 784 A | 11/1960 |
| GB | 2 246 164 A | 1/1992 |

* cited by examiner

*Primary Examiner*—Robin A. Hylton
(74) *Attorney, Agent, or Firm*—Baker Botts L.L.P.; Chang Sik Kim; Gary M. Butter

(57) ABSTRACT

The application describes a closeable bag, pouch or container with an opening which can be closed by means of a lock unit which cooperates with a disposable locking member to close the bag, pouch or container. The opening has first and second opposing sides. The lock unit is on the first side of the opening and has first and second apertures. The second side has first and second apertures corresponding to those of the lock unit. The locking member has first and second protrusions for location in the apertures of the lock unit and the second side of the opening. The second side is clamped between the locking member and the lock unit. At least the second protrusion of the locking member has a configuration such that it locks into the second aperture of the lock unit. The locking member has a line of weakness running between the protrusions such that the first protrusion can be disengaged from the lock unit in a first step and the second protrusion can be disengaged from the lock unit in a second step.

5 Claims, 3 Drawing Sheets

LOCKABLE CONTAINER HAVING TAMPER EVIDENT LOCK UNIT

CROSS REFERENCE TO RELATED APPLICATION

This application is a national phase application of International Application No. PCT/GB01/00088 filed on Jan. 10, 2001 and published in English on Jul. 26, 2001 as International Publication No. WO 01/53163, which claims priority from Great Britain Application No. 0001218.7 filed on Jan. 19, 2000 and published in English as GB 2 358 377 on Jul. 25, 2001.

FIELD OF THE INVENTION

The invention relates to a closable container, for example a bag, pouch or reusable envelope, which has an opening which can be closed. The container has a lock unit at the opening which cooperates with a disposable locking member, to close the container.

BACKGROUND INFORMATION

An envelope with a zipped opening is described in GB-A-1424680. In this reference, the disposable locking member has a head part, a stem part and a plug part. The plug part goes through an aperture in the puller tab of the zipper and engages in an aperture in the lock unit. The envelope is opened by removal of the head part of the locking member, which causes rupture of the stem part with the plug part being left behind in the lock unit or in the envelope. Because the envelope can only be opened by breaking the locking member, a tamper evident seal to the envelope is provided.

In GB-A-2330379 a locking device is disclosed which is in the form of a keyless padlock. A locking bar is inserted into the locking device and is locked in place by means of a disposable locking element. The locking element has a locking post and a plug part, and incorporates a tear line by means of which the locking element can be split into two parts.

It is an aim of the invention to provide an improved and novel locking mechanism for a container or a closable bag or pouch such as a resuable envelope.

SUMMARY OF THE INVENTION

According to the invention there is provided a closeable bag; pouch or container with an opening which can be closed by means of a lock unit which cooperates with a disposable locking member to close the bag, pouch or container, wherein:

i) the opening is closed by adjoining first and second opposing sides;

ii) the lock unit is on the first side and has first and second apertures;

iii) the second side has first and second apertures corresponding to those of the lock unit;

iv) the locking member has first and second protrusions for location in the apertures of the lock unit and the second side, that side being clamped between the locking member and the lock unit;

v) at least the second protrusion of the locking member has a configuration such that it locks into the second aperture of the lock unit; and vi) the locking member has a line of weakness running between the protrusions such that the first protrusion can be disengaged from the lock unit in a first step and the second protrusion can be disengaged from the lock unit in a second step.

The second aperture of the lock unit is advantageously shaped so as to have a narrower portion, in which the second protrusion of the locking member positively engages, and a wider portion which is wide enough to allow removal of the protrusion. The second protrusion can be moved to the wider portion for removal, after removal of the first protrusion.

Preferably the second side of the opening has a location place which receives the locking member, this plate having the apertures of the second side.

The unlocking of the container, pouch or bag of the invention is thus performed by an operation of several steps. The removal of the locking member is performed by two or three steps and this level of complexity presents an effective deterrent to a potential unauthorised accesser to the bag.

BRIEF DESCRIPTION OF THE DRAWINGS

A preferred embodiment of the invention is described in detail below by example only and with reference to the accompanying drawings, wherein.

DETAILED DESCRIPTION

Figure 1:
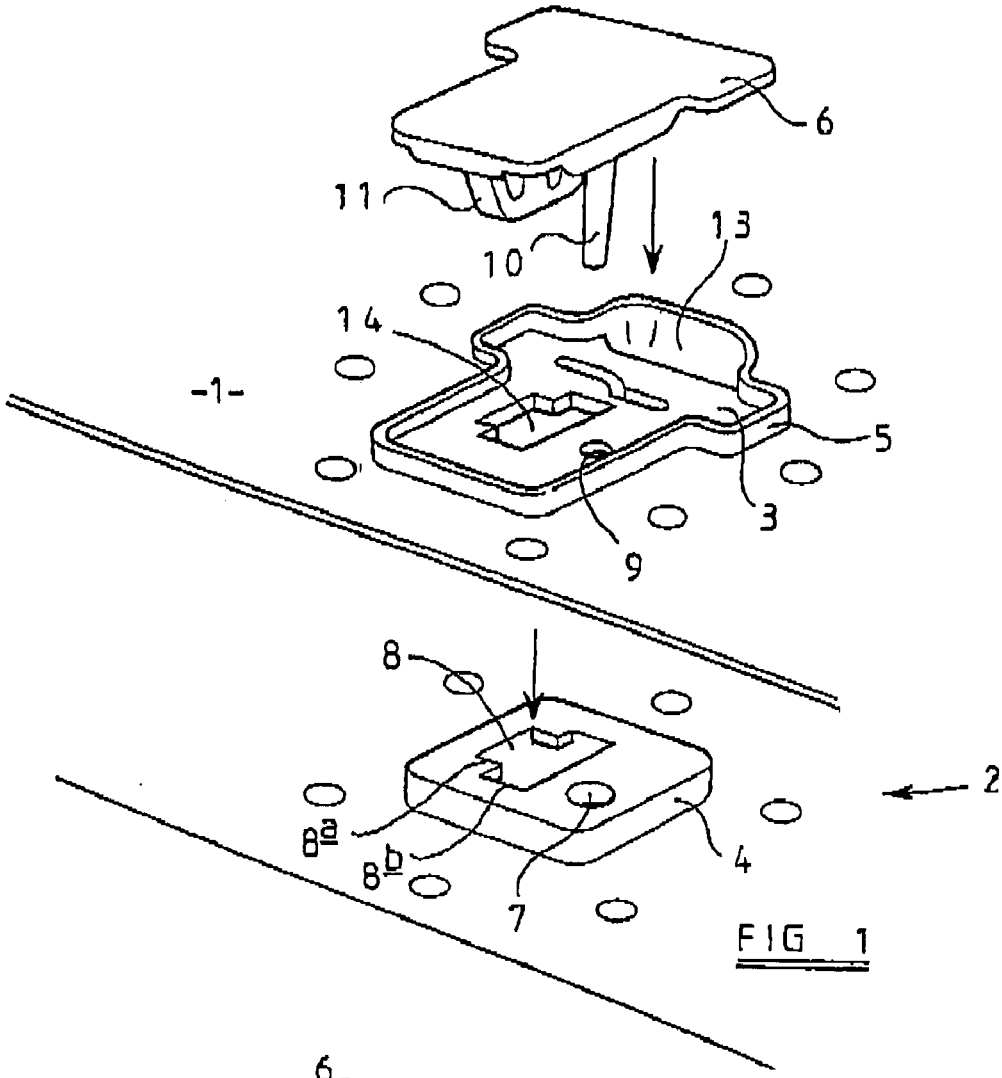
FIG. 1 is a perspective view showing the opening or mouth of a closable bag, pouch or container in accordance with an embodiment of the invention, the view showing the lock unit, the location plate and the locking member.

FIG. 1 shows the mouth of a container, bag or pouch. In this embodiment the container is a closable bag or reusable envelope 1, the bag having an opening 2 which can be closed by a lock unit 4 which cooperates with a disposable locking member 6 to close the bag. The lock unit has a first aperture 7 and a second aperture 8. The lock unit 4 is arranged approximately half way along the opening of the bag; if more than one lock unit is used then they will he evenly spaced along the opening.

The lock unit is arranged on the inside of the first side of the opening 2. On the outside of the second side of the opening, at a position corresponding to that of the lock unit, is arranged a location plate 3. The plate has a generally cruciform configuration with a peripheral rim 5 which thus forms a seat for the locking member 5. At the top of the cruciform shape, there is a slightly hollowed region 13 which acts as a finger hole, so that the user can gain some purchase on the edge of the locking member 6 when it is located on the plate 3.

The location plate 3 has a first aperture 9 which registers with the first aperture 7 of the lock unit 4 and a second aperture 14 which registers with the second aperture 8 of the lock unit. The location plate 3 is fixed to the material on the second side of the opening of the bag by location through a hole in the material the shape of which corresponds to the external shape of the rim 5 of the plate 3. Extending outwardly from the rim is a flange 15 (seen in FIG. 4) which is on the inside of the bag 1. The material of the bag is then rivoted to the flange of the location plate so as to fix it on the bag.

The lock unit 4 is connected on the opposite side of the opening to the bag in a corresponding fashion, though with the lock unit the surrounding flange 15' is then on the outside of the opening of the bag. The lock unit 4 extends upwardly from the flange, to form a chamber which can accommodate protrusions 10, 11 of the locking member. On the underside of the location plate 3 there is a recessed seat 16 (FIG. 4) to aid correct positioning of the lock unit 4 and location plate 3 together, when the opening of the bag is closed.

Figure 2:
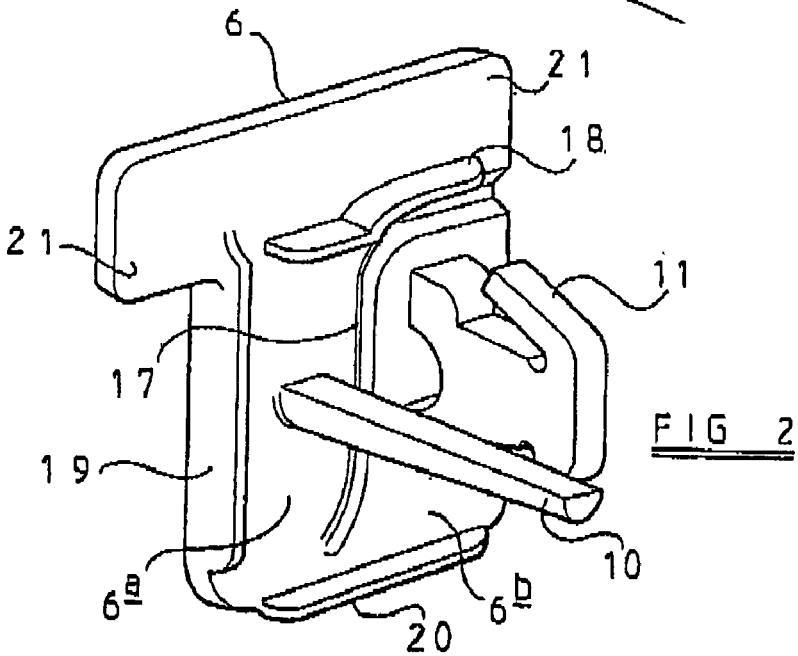
FIG. 2 is a perspective view of a disposable locking member for use with the lock unit of FIG. 1, the view showing the locking member from the rear so that the protrusions of the locking member are visible.

As seen best in FIG. 2, the looking member 6, which is of a generally T-shaped and planar configuration, has on one side a first protrusion 10 and a second protrusion 11 for location in the apertures 7 and 8 of the lock unit. Assuming correct usage of the locking member 6, the protrusions 10 and 11 of the locking member will be located in the apertures of the location plate 3 and the lock unit 4. Thus, the protrusion 10 of the locking member will penetrate the aperture 9 of the plate, before penetrating the aperture 7 of the lock unit. The protrusion 10 is, in this embodiment, in the form of a tapered post. The second protrusion 11 of the locking member 6 has a configuration, for example an arrow head configuration, such that it positively engages or locks into the second aperture 8 of the lock unit.

The locking member 6 has a line of weakness 17 running across it, between the protrusions 10 and 11, so that the first protrusion 10 can be removed from the lock unit 4 and from the plate 3 in a first step, the second protrusion 11 then being disengaged from the lock unit in a subsequent, second step. The line of weakness 17 can be formed as a line of reduced thickness running from one side edge and then down between the protrusions to end close to the lower edge of the locking member, and so it effectively divides the member into first and second parts 6*a*, 6*b*.

The member 6 includes upper, side and lower lips 18, 19 and 20 which aid proper fitting on the location plate. The member also has "ears" 21 projecting from the top corners, the ears forming the cross-piece of the "T" shapes.

As clearly visible in FIG. 1, the second aperture 8 of the lock unit 4 and the second aperture 14 of the location plate 3 advantageously have a narrower portion 8*a* and a wider portion 8*b*. The arrow head shaped protrusion 11 of the locking member 6 engages in the narrower portion 8*a* (as described in more detail below with reference to FIG. 3), whereas the wider portion 8*b* is of sufficient size such that the protrusion 11 can disengage from the aperture 8. The movement of the protrusion 11 from the narrower portion 8*a* to the wider portion 8*b* of the aperture 8 is described later.

The way in which the bag 1 is closed will now be described. The sides of the opening to the bag are placed together, obviously with the desired contents of the bag inside. The lock unit 4 is located against the inner seat of the location plate 3 so that the apertures of the location plate register with the apertures of the locking unit. The locking member 6 is then pushed onto the location plate 3 and into the lock unit 4 to lock two sides of the opening together, thus securing the bag in a closed condition. The first protrusion 10 of the locking member 6 passes through the first aperture 9 of the location plate 3 and then penetrates the lock unit 4, through the aperture 7. The second protrusion 11 of the locking member 6 passes through the second aperture 14 of the plate 3 and penetrates into the aperture 8 of the lock unit 4, the arrow head configuration of the second protrusion locking in the aperture 8. For the avoidance of any doubt, the arrow head protrusion 11 engages behind the narrow portion 8*a* of the aperture 8 at this stage.

The bag 1 is now securely closed and can only be opened by removal of the locking member 6. As will be discussed in more detail below, the locking member 6 can only be removed by breaking the locking member and so unauthorised opening of the bag is immediately obvious. The locking member thus provides a tamper evident seal to the bag. The locking members will be individually numbered so that unauthorised access to the bag will be observable, even if the locking member is replaced. Individual numbering of locking members of this type—so-called "seals"—is known in the art.

Figure 3A:
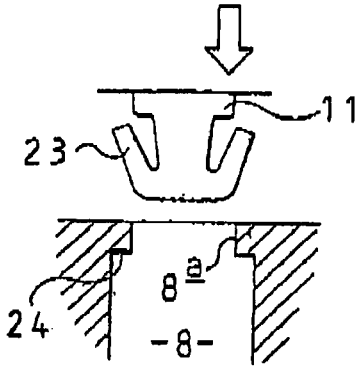
FIGS. 3*a* to 3*c* are detailed sectional views showing the engagement of the second protrusion of the locking member with the lock unit.
Figure 3B:
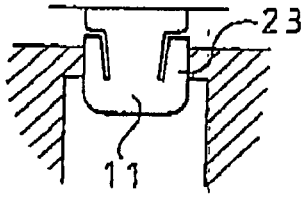
Figure 3C:
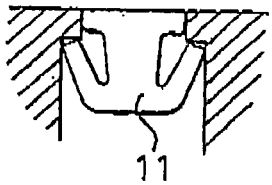

The removal of the locking member 6 and thus the unlocking of the bag will now be described, FIGS. 3*a, b* and *c* show in more detail the location of the protrusion 11 of the sealing member 6 in the narrower portion 8*a* of the aperture 8 of the lock unit 4. The arrow head has opposing barbs 23 which in the relaxed condition have an overall width which is greater than that of the portion 8*a* of the aperture 8. The protrusion member 11 is formed of a suitable resilient plastics material such that the barbs 23 can be bent resiliently inwards. In the inward position, the overall width of the barbs is the same as or slightly less than the width of the portion 8*a* of the aperture 8. The aperture 8 has, on the inside of the lock unit 4 a widened portion with internal shoulders 24. Thus, upon pressing in of the protrusion 11 into the aperture 8 the barbs 23 of the arrow head are squeezed inwards but then flexed outwardly to engage behind the shoulders 24 of the aperture 8. In this position, the locking member 6 is at least temporarily locked in the lock unit 4, with the location plate 3 therebetween. It should be noted that in FIGS. 3*a, b* and *c* the full length of the protrusion 11 is not seen; obviously the length of the protrusion member is such that between the lock unit 4 and the sealing member 6 there is a sufficient distance to accommodate the thickness of the bag material and the location plate 3.

FIGS. 4*a* to 4*f* indicate longitudinal cross sectional views through the lock unit 4 and the location place 3 and in particular show the sequence of removal of the locking member 6 and thus the opening of the bag. The protrusion 11 is positively engaged in the aperture 8, as just described, while the shape of the protrusion 10 corresponds to the shape of the aperture 7 so that it slides easily in and out.

Figure 4A:
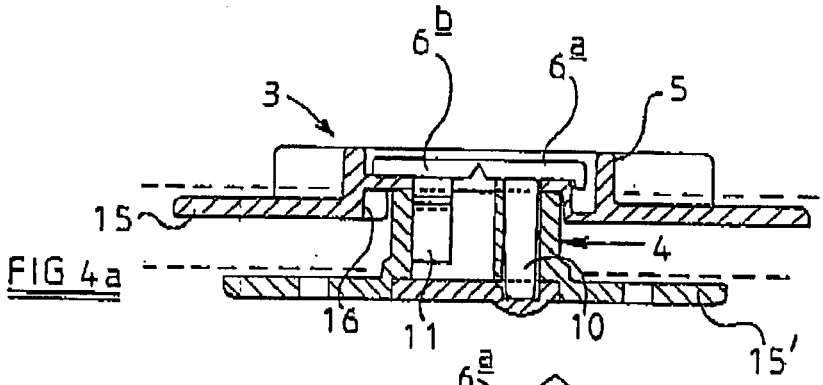
FIGS. 4*a* to 4*f* are detailed longitudinal sectional views showing the steps for removal of the locking member from the lock unit and thus the opening of the mouth of the container, pouch or bag.

In FIG. 4*a* is seen the location plate 3 in position on the lock unit 4 with the locking member 6 placed thereover, the protrusions 10, 11 of the locking member thus going into the lock unit. The material of the bag, at each opposing side of the opening, is shown in FIG. 4*a* in dashed lines but is omitted in the other figures for clarity. The lock unit 4 and location plate 3 are fixed to the material of the bag by means of rivets through the peripheral flanges 15 of the plate 3 and unit 4. The rivets are visible in FIG. 1.

Figure 4B:
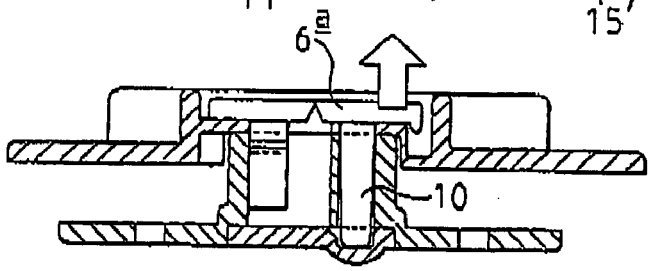

FIG. 4*b* indicates the first step in the removal of the locking member 6. The user's finger lifts the top edge of the locking member 6, using the recessed portion 13 of the location plate, to break the locking member along the break line 17 and remove the right hand portion 6*a* of the locking member away from the lock unit. Only limited resistance against this removal is provided by the strength of the break line. The protrusion 10 of the locking member 6 slides easily in and out of the aperture of the lock unit and does not lock inside the aperture (though in an alternative embodiment such locking could occur).

Figure 4C:
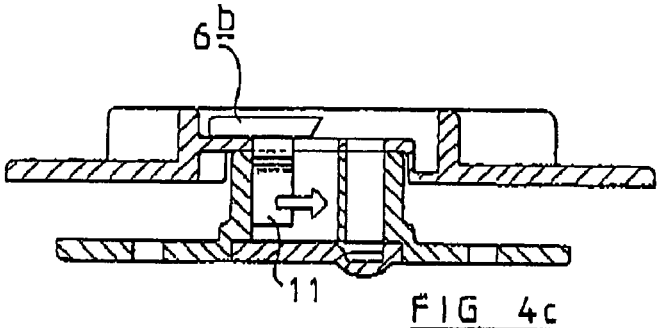
Figure 4D:
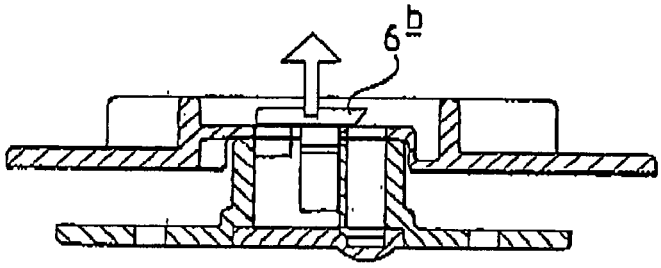
Figure 4E:
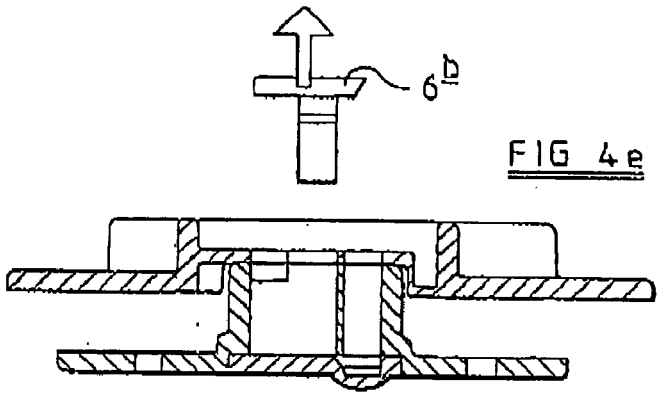
Figure 4F:
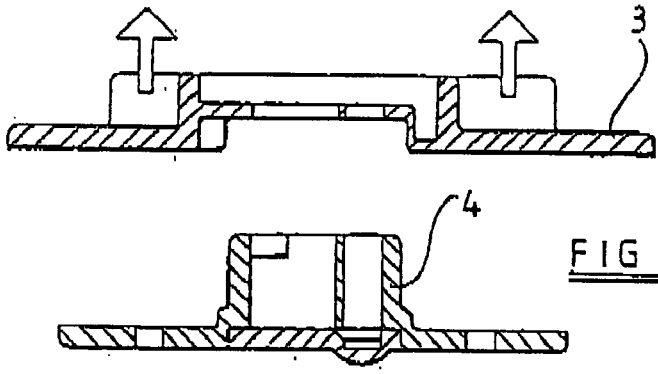

FIG. 4*c* shows the right hand part 6*a* of the locking member removed. With the protrusion 10 no longer located in the aperture 7 of the lock unit and the right hand part of the locking member no longer abutting the rim 5 of the location plate, the left hand part 6*b* of the locking member is free to move and, in particular, the protrusion 11 can move across the aperture 8 of the lock unit 4 so that the arrow head is located at the wider portion 8*b* of the aperture 8. The movement of the left hand part 6*b* of the locking member across the seat of the lock unit can be facilitated by the user pushing it across. As soon as the arrow head of the protrusion 11 is located at the wider portion 8*b* of the aperture 8, as seen in FIG. 4*d*, that part of the locking member can be removed. This is indicated in FIG. 4*e*. With both parts 6*a*, 6*b* of the locking member removed the side of the bag with the location plate can be lifted away from the lock unit 4, as shown in FIG. 4*f*, and the mouth 2 of the bag can be pulled open.

If the lock unit 4 is formed with an aperture 8 which does not have a wider portion 8*b* to allow removal of the arrow head of the locking member, then removal of the left hand part 6*b* of the locking member may occur by forcibly removing it, thus breaking off the barbs 23 (or the protrusion itself) which will fall inside the lock unit. The barbs 23 can be removed from the lock unit by turning the bag upside down and shaking.

Although in the described embodiment the bag is closed by opposing sides of the mouth of the bag being connected together by the locking unit and locking member, in a variation the bag could have a fold-over flap—like an envelope—so that the locking unit is on the front of the bag and the location plate is on the front of the flap which folds over onto the front of the bag.

The lock unit and the location plate may be formed of a suitable metal, such as hardened steel, or of plastic such as nylon, polypropylene, ABS, styrene or engineering plastic. The disposable locking members, which will generally be supplied in bulk, are formed of suitable resilient but frangible plastics material, such as styrene, nylon or polypropylene.

What is claimed is:

1. A closeable container having an opening, comprising:

a lock unit which is adapted for closing the opening; and a disposable locking member cooperating with the lock unit to close the container, wherein:

i) the opening is closed by adjoining first and second opposing sides, ii) the lock unit is on the first side and has first and second apertures, iii) the second side has first and second apertures corresponding to those of the lock unit, iv) the locking member has a body with first and second protrusions extending therefrom for location in the apertures of the lock unit and the second side, the second side being clamped between the locking member and the lock unit, v) at least the second protrusion of the locking member has a configuration such that it locks into the second aperture of the lock unit, and vi) the locking member has a line of weakness extending across the body and between the protrusions such that the first protrusion and a first part of the locking member is disengageable from the lock unit in a first instance, and the second protrusion and a second portion of the locking member is disengageable from the lock unit in a second instance which follows the first instance.

2. The closeable container according to claim 1, wherein the second aperture of the lock unit is shaped to have a narrower portion, in which the second protrusion of the locking member positively engages, and has a wider portion having a width to allow a removal of the protrusion.

3. The closesable container according to claim 1, wherein the apertures of the said second side are provided in a location plate in which the locking member is sealed.

4. The closeable container according to claim 1, wherein the second protrusion of the locking member has an arrowhead configuration, and the first protrusion is a post.

5. The closeable container according to claim 1, wherein the body is planar.

* * * * *